US007761940B2

(12) United States Patent
Hipp

(10) Patent No.: US 7,761,940 B2
(45) Date of Patent: Jul. 27, 2010

(54) CORNER COMPONENTS FOR A BED SHEET

(75) Inventor: Cooper Hipp, 401 S. First St. #617, Minneapolis, MN (US) 55401

(73) Assignee: Cooper Hipp, Minneapolis, MN (US)

( * ) Notice: Subject to any disclaimer, the term of this patent is extended or adjusted under 35 U.S.C. 154(b) by 0 days.

(21) Appl. No.: 12/176,022

(22) Filed: Jul. 18, 2008

(65) Prior Publication Data

US 2010/0011503 A1 Jan. 21, 2010

(51) Int. Cl.
*A47G 9/02* (2006.01)

(52) U.S. Cl. ..... 5/488; 5/482; 5/495; 5/497

(58) Field of Classification Search ..... 5/482, 5/488, 495–499, 413 R; 24/72.5, 696
See application file for complete search history.

(56) References Cited

U.S. PATENT DOCUMENTS 3,469,290 A * 9/1969 Andrews ..... 24/691
4,934,939 A * 6/1990 Bonneville ..... 434/247
5,321,862 A * 6/1994 Campbell ..... 5/482
7,089,634 B1 * 8/2006 Dunning ..... 24/707.4
2006/0236455 A1 * 10/2006 Chang ..... 5/482

OTHER PUBLICATIONS

"Making your bed, made easy", [online] [retrieved Jul. 18, 2008]. Retrieved from the Internet: <URL: http://www.selectcomfort.com/product_research/about_researcharticledisplay.cfm?title=&...>,1 pg.

* cited by examiner

*Primary Examiner*—Peter M Cuomo
*Assistant Examiner*—Nicholas Polito
(74) *Attorney, Agent, or Firm*—Schwegman, Lundberg & Woessner, P.A.

(57) ABSTRACT

In some example, an apparatus comprises a first corner component that is configured to be attached to a first corner of a bed sheet. The first corner component comprises a first bottom attachment to couple to the first cap. The apparatus includes a second corner component that is configured to be attached to a second corner of the bed sheet that is on an opposite end but same side relative to the first corner. The second corner component comprises a second bottom attachment to couple to the second.

20 Claims, 5 Drawing Sheets

CORNER COMPONENTS FOR A BED SHEET

BACKGROUND

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

There are different types and sizes of bed sheets. For example, the types include fitted, flat, etc., while the sizes include single, double, queen, king, etc.

BRIEF DESCRIPTION OF THE DRAWINGS

The embodiments are provided by way of example and not limitation in the figures of the accompanying drawings, in which like references indicate similar elements and in which.

DETAILED DESCRIPTION

Figure 1:
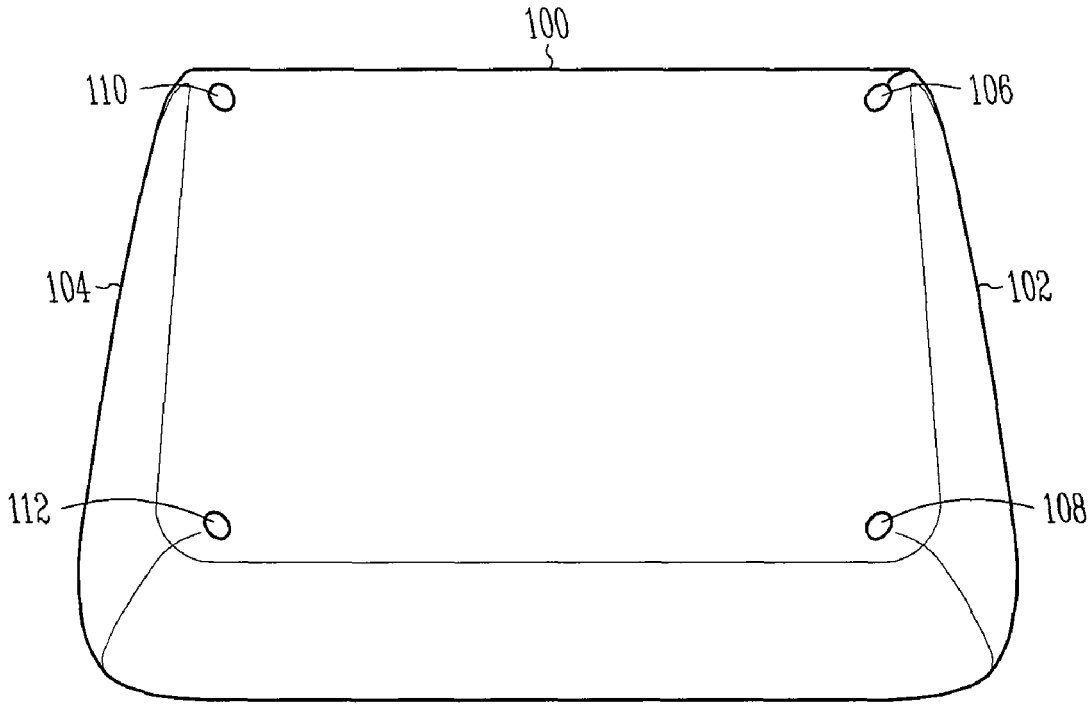
FIG. 1 illustrates a bed sheet, according to some example embodiments.

Methods, apparatus and systems for corner components for a bed sheet are described. In the following description, numerous specific details are set forth. However, it is understood that embodiments of the invention may be practiced without these specific details. In other instances, structures and techniques have not been shown in detail in order not to obscure the understanding of this description.

Some example embodiments include one or more components that are attached to corners of a bed sheet to enable fitting of the bed sheet on a bed mattress. In some example embodiments, these same components may also be used to enable the folding of the bed sheet. Some example embodiments may be used on any type of bed sheet (e.g., fitted, flat, etc.). Further, these components may be permanently or detachably affixed to the bed sheet.

In some example embodiments, there is a component for each of the four corners of the bed sheet. In some example embodiments, a given component may include a cap and a bottom attachment wherein the bed sheet is in between when the cap and the bottom attachment are coupled together. The cap may be positioned on top of the bed sheet relative to when the bed sheet is placed on a bed mattress. Moreover, the cap may include some type of label to identify which corner of the bed mattress that the corner of the bed sheet is to be placed. For example, the labels may be head-right, head-left, foot-right and foot-left. Such labels ensure that the person placing the sheet on the mattress does so on a first attempt. In particular, a bed sheet and mattress are generally rectangular (not square). Accordingly, this rectangular shape prevents any corner of the sheet being placed on any corner of the mattress. Incorrectly placing a first corner of the sheet onto the mattress precludes a person from correctly placing the remaining three corners onto the mattress. The labels, in accordance with some example embodiments, preclude the misaligning of the corners of the sheet with the corners of the mattress.

Moreover, in some example embodiments, these same corner components may also be used in folding the bed sheet. Folding bed sheets (especially fitted sheets) may be problematic because of the gathered edges that are used to keep the sheet fitted on the mattress. Proper folding of fitted sheets generally reduces the size of the sheet after the folding is completed. In some example embodiments, the bottom attachment of these components include a female or male fastener. For example, the components at the top and the bottom of the sheet may be female and male, respectively (or vice versa). As further described below, as part of the folding of the sheet, the top fasteners are attached to the bottom fasteners for the two different sides of the sheet. In some example embodiments, the caps of the top components include loops that are used to hold the sheet while the sheet is being folded. These loops may be a part of the caps. Alternatively, these loops may be separate components that are positioned between the cap and the bottom attachment after the cap and the bottom attachment are coupled together. Accordingly, as described, some example embodiments include corner components for bed sheets that allow for a person (1) to more easily place the sheet on a mattress and (2) to more easily fold the sheet.

FIG. 1 illustrates a bed sheet, according to some example embodiments. In particular, FIG. 1 illustrates a bed sheet 100 that includes a head 102 and a foot 104. The bed sheet 100 may be any type of bed sheet (e.g., fitted, flat, etc.). Four corner components are attached at the four corners of the bed sheet 100. A corner component 106 is attached to a corner at the head, left side of the bed sheet 100. A corner component 108 is attached to a corner at the head, right side of the bed sheet 100. A corner component 110 is attached to a corner at the foot, left side of the bed sheet 100. A corner component 112 is attached to a corner at the foot, right side of the bed sheet 100. These corner components may be permanently or detachably affixed to the bed sheet 100. A more detailed description of the corner components is now described.

Figure 2C:
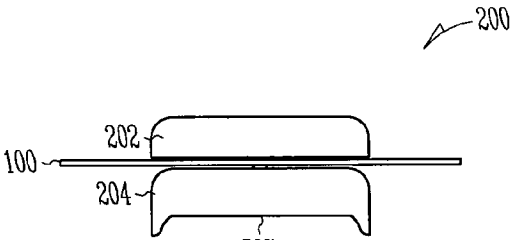
FIGS. 2A-2C illustrate a corner component having a female fastener, according to some example embodiments.
Figure 2B:
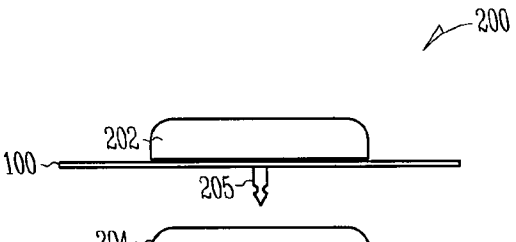
Figure 2A:
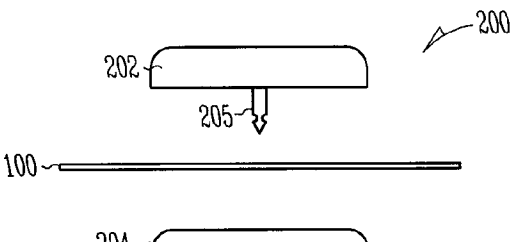

FIGS. 2A-2C illustrate a corner component having a female fastener, according to some example embodiments. FIGS. 2A-2C illustrate a corner component 200 that may be representative of any of the corner components of FIG. 1. The corner component 200 includes a cap 202 and a bottom attachment 204. The bottom attachment 204 includes a female fastener 207. As further described below, another type of corner component includes a male fastener. Accordingly, two corner components are couple together using the female and male fasteners. In particular, these fasteners may be used for coupling together when the bed sheet is being folded.

As shown, the bed sheet 100 is between the cap 202 and the bottom attachment 204 when the two are attached together. The cap 202 includes a pin 205 that is inserted into a receiver section of the bottom attachment 204 when the cap 202 is attached to the bottom attachment 204. The pin 205 pierces the bed sheet 100 and is then inserted into the receiver section of the bottom attachment 204. Accordingly, the cap 202 is secured to the bottom attachment 204 with the bed sheet 100 in between.

Figure 3C:
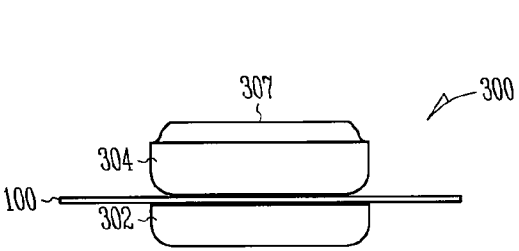
FIGS. 3A-3C illustrate a corner component having a male fastener, according to some example embodiments.
Figure 3B:
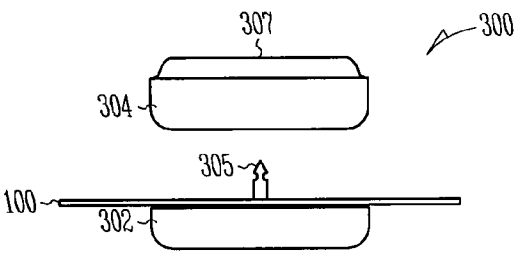
Figure 3A:
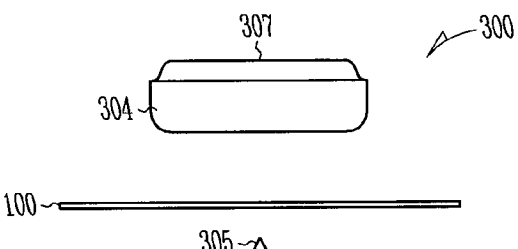

FIGS. 3A-3C illustrate a corner component having a male fastener, according to some example embodiments. FIGS. 3A-3C illustrate a corner component 300 that may be representative of any of the corner components of FIG. 1. The corner component 300 includes a cap 302 and a bottom attachment 304. The bottom attachment 304 includes a male fastener 307.

As shown, the bed sheet 100 is between the cap 302 and the bottom attachment 304 when the two are attached together. The cap 302 includes a pin 305 that is inserted into a receiver section of the bottom attachment 304 when the cap 302 is attached to the bottom attachment 304. The pin 305 pierces the bed sheet 100 and is then inserted into the receiver section of the bottom attachment 304. Accordingly, the cap 302 is secured to the bottom attachment 304 with the bed sheet 100 in between.

In some example embodiments for a given bed sheet, two corner components include a female fastener and two corner components include a male fastener. For example, the two corner components at the head of the bed sheet may include female fasteners, while the two corner components at the foot of the bed sheet may include male fasteners. Alternatively, the two corner components at the head of the bed sheet may include male fasteners, while the two corner components at the foot of the bed sheet may include female fasteners. Alternatively, the two corners components on the left side of the bed sheet may include female fasteners, while the two corner components on the right side of the bed sheet may include male fasteners, or vice versa relative to the sides of the bed sheet.

In some example embodiments, the cap 202 and the cap 302 are on the top side of the bed sheet relative to the bed sheet being placed on a bed mattress. The cap 202 and the cap 302 may include some type of label to identify which corner of the bed mattress that the corner of the bed sheet is to be placed. For example, the labels may be head-right, head-left, foot-right and foot-left. Such labels ensure that the person placing the sheet on the mattress does so on a first attempt (as described above).

While FIGS. 2 and 3 illustrate a pin and receiver section for coupling the two parts of the corner components together, embodiments are not so limited. In some example embodiments, the cap and the bottom attachment may be in a button configuration for snapping together. In some example embodiments, the cap and the bottom attachment may be attached to the bed sheet via VELCRO® (hook and loop fastener) or stitching. Accordingly, the cap and the bottom attachment are not directly coupled together.

Figure 4:
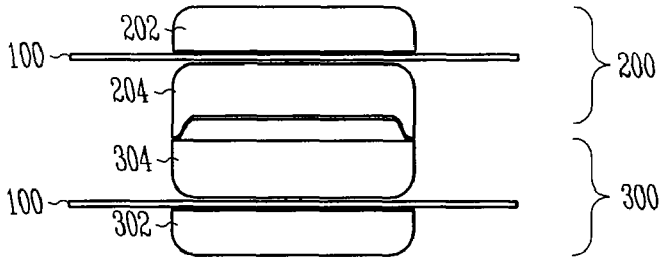
FIG. 4 illustrates two corner components for two corners of a bed sheet that are coupled together, according to some example embodiments.

FIG. 4 illustrates two corner components for two corners of a bed sheet that are coupled together, according to some example embodiments. In particular, FIG. 4 illustrates two corner components couple together through the female fastener of a first bottom attachment of a first corner component and the male fastener of a second bottom attachment of a second corner component. In FIG. 4, the corner component 200 of FIG. 2 is coupled to the corner component 300 of FIG. 3. As shown, the female fastener of the corner component 200 is attached to the male fastener of the corner component 300. This enables two corners of a bed sheet to be coupled together. For example, the head and the foot for a given side of a bed sheet may be coupled together. As described below, such coupling may be used to the folding of the bed sheet.

Figure 5:
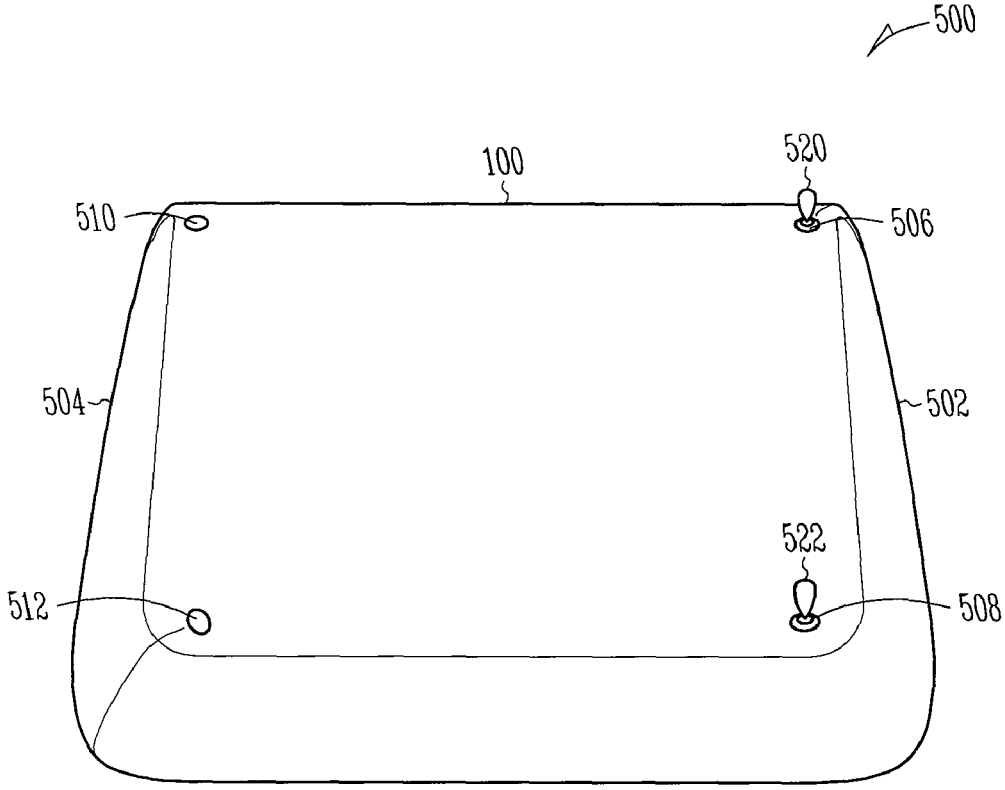
FIG. 5 illustrates a top side of bed sheet having corner components that include loops, according to some example embodiments.

FIG. 5 illustrates a top side of bed sheet having corner components that include loops, according to some example embodiments. In particular, FIG. 5 includes a top side of a bed sheet 500 relative to its positioned after being placed on a bed mattress. The bed sheet 500 includes a head 502 and a foot 504. The bed sheet 500 may be any type of bed sheet (e.g., fitted, flat, etc.). Four corner components are attached at the four corners of the bed sheet 500. A cap 506 of a corner component is attached to a corner at the head, left side of the bed sheet 500. A cap 508 of a corner component is attached to a corner at the head, right side of the bed sheet 500. A cap 510 of a corner component is attached to a corner at the foot, left side of the bed sheet 500. A cap 512 of a corner component is attached to a corner at the foot, right side of the bed sheet 500. These corner components may be permanently or detachably affixed to the bed sheet 500.

A loop 520 is positioned at the corner at the head, left side of the bed sheet 500. A loop 522 is positioned at the corner at the head, right side of the bed sheet 500. In some example embodiments, the loops 520 and 522 may be permanently affixed to the caps 506 and 508, respectively. Alternatively, the loops 520 and 522 may be separate components that are positioned between the caps 506 and 508, respectively, after the caps are coupled to their associated bottom attachments. As further described below, the loops 520 and 522 may be used to assisting the folding of the bed sheet.

Figure 6:
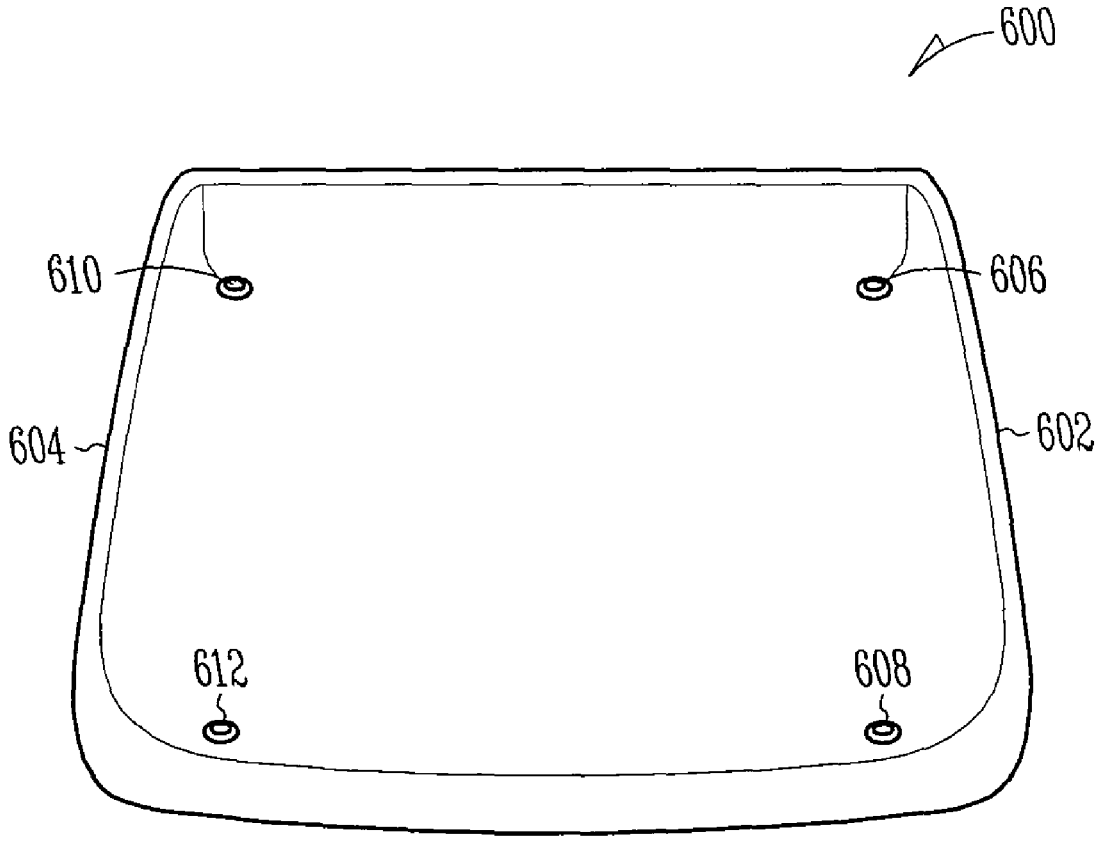
FIG. 6 illustrates a bottom side a bed sheet having corner components, according to some example embodiments.

FIG. 6 illustrates a bottom side a bed sheet having corner components, according to some example embodiments. In particular, FIG. 6 includes a bottom side of a bed sheet 600 relative to its positioned after being placed on a bed mattress. The bed sheet 600 includes a head 602 and a foot 604. The bed sheet 600 may be any type of bed sheet (e.g., fitted, flat, etc.). Four corner components are attached at the four corners of the bed sheet 600. A bottom attachment 606 of a corner component is attached to a corner at the head, left side of the bed sheet 600. A bottom attachment 608 of a corner component is attached to a corner at the head, right side of the bed sheet 600. A bottom attachment 610 of a corner component is attached to a corner at the foot, left side of the bed sheet 600. A bottom attachment 612 of a corner component is attached to a corner at the foot, right side of the bed sheet 600. These corner components may be permanently or detachably affixed to the bed sheet 600.

FIGS. 5-6 illustrate having two loop positioned on the top side and at the head of the bed sheet. However, embodiments are not so limited. In some example embodiments, there may be a greater or lesser number of loops. Also, in some example embodiments, if there are two loops, the two loops may be in other positions (e.g., foot, left side, right side, opposite corners, etc.). Also, in some example embodiments, the loops may be positioned on the bottom side of the bed sheet.

FIGS. 7A-7D illustrate a method for folding a bed sheet having corner components, according to some example embodiments. In particular, FIGS. 7A-7D illustrate a method for folding a bed sheet 700. While illustrated relative to having loops, in some example embodiments, the method may be performed without the loops.

Figure 7A:
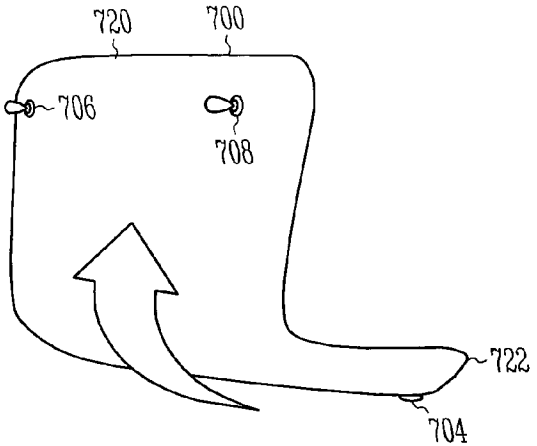
FIGS. 7A-7D illustrate a method for folding a bed sheet having corner components, according to some example embodiments.
Figure 7B:
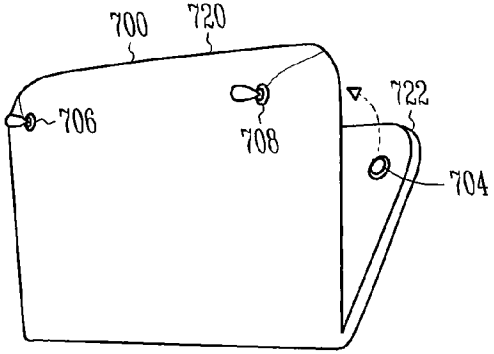

In FIG. 7A, the person folds the bed sheet 700 such that a head 720 is folded into the foot 722 of the bed sheet 700. In FIG. 7B, using their right hand, a user holds a loop for a cap 708 positioned at the head, right side of the bed sheet 700. Using their left hand, the user locates a bottom attachment 704. The user then connects the male fastener of the bottom attachment 704 to the female fastener of the cap 708. Using their left hand, a user holds a loop for a cap 706 positioned at the head, left side of the bed sheet 700. Using their right hand, the user locates a bottom attachment on the foot, bottom side (not shown). The user then connects the male fastener of the bottom attachment (not shown) to the female fastener of the cap 706.

Figure 7C:
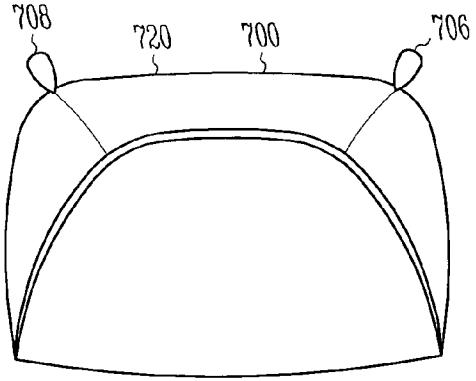
Figure 7D:
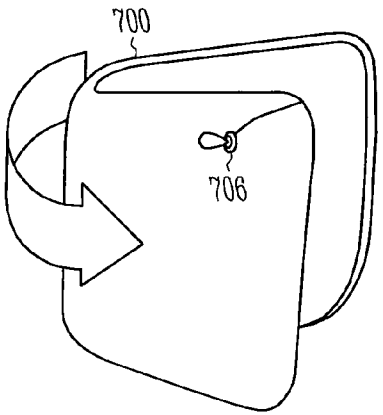

In FIG. 7C, the user holds the loop for the cap 708 in their left hand and holds the loop for the cap 706 in their right hand. This holding creates a flat draping of the bed sheet 700. In FIG. 7D, the user brings together the two loops, thereby folding the bed sheet 700. Depending on the desired folded size, the user may continue folding the bed sheet 700 in half until the desired storage size is achieved.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. An apparatus comprising: a first corner component that is configured to be attached to a first corner of a bed sheet, the first corner component comprising a first cap having a top that includes a label that identifies which corner of a bed that the first corner of the bed sheet is to be positioned, the first corner component comprising a first bottom attachment to couple to the first cap with the first corner of the bed sheet in between, wherein the first bottom attachment includes a first female fastener that is not used to attach the first cap to the first bottom attachment; and a second corner component that is configured to be attached to a second corner of the bed sheet that is on an opposite end but same side relative to the first corner, the second corner component comprising a second cap having a top that includes a label that identifies which corner of a bed that the second corner of the bed sheet is to be positioned, the second corner component comprising a second bottom attachment to couple to the second cap with the second corner of the bed sheet in between, wherein the second bottom attachment includes a first male fastener that is not used to attach the second cap to the second bottom attachment, wherein the first female fastener is configured to be coupled to the first male fastener during folding of the bed sheet; wherein a first loop is attached to the first cap.

2. The apparatus of claim 1, wherein the bed sheet comprises a fitted bed sheet.

3. The apparatus of claim 1, wherein the bed sheet comprises a flat bed sheet.

4. The apparatus of claim 1, wherein a folder of the bed sheet is hold the first loop during at least a part of the folding of the bed sheet when the first female fastener is to be coupled to the first male fastener.

5. The apparatus of claim 1, wherein a size of the bed sheet comprises king size.

6. The apparatus of claim 1, further comprising: a third corner component that is configured to be attached to a third corner of a bed sheet, the third corner component comprising a third cap having a top that includes a label that identifies which corner of a bed that the third corner of the bed sheet is to be positioned, the third corner component comprising a third bottom attachment to couple to the third cap with the third corner of the bed sheet in between, wherein the third bottom attachment includes a second female fastener that is not used to attach the third cap to the third bottom attachment; and a fourth corner component that is configured to be attached to a fourth corner of the bed sheet that is on an opposite end but same side relative to the third corner, the fourth corner component comprising a fourth cap having a top that includes a label that identifies which corner of a bed that the fourth corner of the bed sheet is to be positioned, the fourth corner component comprising a fourth bottom attachment to couple to the fourth cap with the fourth corner of the bed sheet in between, wherein the fourth bottom attachment includes a second male fastener that is not used to attach the fourth cap to the fourth bottom attachment, wherein the second female fastener is configured to be coupled to the second male fastener during folding of the bed sheet.

7. The apparatus of claim 6, wherein a second loop is attached to the third cap, wherein a folder of the bed sheet is to hold the second loop during at least a part of the folding of the bed sheet when the second female fastener is to be coupled to the second male fastener.

8. The apparatus of claim 6, wherein a size of the bed sheet comprises king size.

9. An apparatus comprising: a bed sheet comprising, a first corner component that is configured to be attached to a first corner of the bed sheet, the first corner component comprising a first cap having a top that includes a label that identifies which corner of a bed that the first corner of the bed sheet is to be positioned, the first corner component comprising a first bottom attachment to couple to the first cap with the first corner of the bed sheet in between, wherein the first bottom attachment includes a first female fastener that is not used to attach the first cap to the first bottom attachment; a second corner component that is configured to be attached to a second corner of the bed sheet that is on an opposite end but same side relative to the first corner, the second corner component comprising a second cap having a top that includes a label that identifies which corner of a bed that the second corner of the bed sheet is to be positioned, the second corner component comprising a second bottom attachment to couple to the second cap with the second corner of the bed sheet in between, wherein the second bottom attachment includes a first male fastener that is not used to attach the second cap to the second bottom attachment, wherein the first female fastener is configured to be coupled to the first male fastener during folding of the bed sheet; a third corner component that is configured to be attached to a third corner of a bed sheet, the third corner component comprising a third cap having a top that includes a label that identifies which corner of a bed that the third corner of the bed sheet is to be positioned, the third corner component comprising a third bottom attachment to couple to the third cap with the third corner of the bed sheet in between, wherein the third bottom attachment includes a second female fastener that is not used to attach the third cap to the third bottom attachment; and a fourth corner component that is configured to be attached to a fourth corner of the bed sheet that is on an opposite end but same side relative to the third corner, the fourth corner component comprising a fourth cap having a top that includes a label that identifies which corner of a bed that the fourth corner of the bed sheet is to be positioned, the fourth corner component comprising a fourth bottom attachment to couple to the fourth cap with the fourth corner of the bed sheet in between, wherein the fourth bottom attachment includes a second male fastener that is not used to attach the fourth cap to the fourth bottom attachment, wherein the second female fastener is configured to be coupled to the second male fastener during folding of the bed sheet; wherein a first loop is attached to the first cap.

10. The apparatus of claim 9, wherein a folder of the bed sheet is hold the first loop during at least a part of the folding of the bed sheet when the first female fastener is to be coupled to the first male fastener.

11. The apparatus of claim 10, wherein a second loop is attached to the third cap, wherein a folder of the bed sheet is to hold the second loop during at least a part of the folding of the bed sheet when the second female fastener is to be coupled to the second male fastener.

12. The apparatus of claim 9, wherein the bed sheet comprises a fitted bed sheet.

13. The apparatus of claim 9, wherein the bed sheet comprises a flat bed sheet.

14. The apparatus of claim 9, wherein a size of the bed sheet comprises king size.

15. A method comprising: folding a bed sheet, wherein the folding comprises, holding a first loop that is part of a first cap of a first corner component, wherein the first cap is coupled to a first bottom attachment of the first corner component with a first corner of the bed sheet in between; holding a second loop that is part of a second cap of a second corner component, wherein the second cap is coupled to a second bottom attachment of the second corner component with a second corner of the bed sheet in between; connecting, while holding the first loop, a first female fastener that is part of the first bottom attachment to a first male fastener of a third bottom attachment of a third corner component, wherein a third cap of the third corner component is coupled to the third bottom attachment with a third corner of the bed sheet in between, wherein the third corner is on an opposite end but same side relative to the first corner; and connecting, while holding the second loop, a second female fastener that is part of the second bottom attachment to a second male fastener of a fourth bottom attachment of a fourth corner component, wherein a fourth cap of the fourth corner component is coupled to fourth bottom attachment with a fourth corner of the bed sheet in between, wherein the fourth corner is on an opposite end but same side relative to the second corner.

16. The method of claim 15, wherein folding the bed sheet comprises bringing together the first corner having the first loop of the first corner component and the second corner having the second loop of the second corner component.

17. The method of claim 15, wherein the bed sheet comprises a fitted bed sheet.

18. The method of claim 15, wherein the bed sheet comprises a flat bed sheet.

19. The method of claim 15, wherein a size of the bed sheet comprises king size.

20. An apparatus comprising: a first corner component that is configured to be attached to a first corner of a bed sheet, the first corner component comprising a first cap having a top, the first corner component comprising a first bottom attachment to couple to the first cap with the first corner of the bed sheet in between, wherein the first bottom attachment includes a first female fastener that is not used to attach the first cap to the first bottom attachment; and a second corner component that is configured to be attached to a second corner of the bed sheet that is on an opposite end but same side relative to the first corner, the second corner component comprising a second cap having a top, the second corner component comprising a second bottom attachment to couple to the second cap with the second corner of the bed sheet in between, wherein the second bottom attachment includes a first male fastener that is not used to attach the second cap to the second bottom attachment, wherein the first female fastener is configured to be coupled to the first male fastener during folding of the bed sheet; wherein a first loop is attached to the first cap.

* * * * *